US006176886B1

(12) United States Patent
Loper et al.

(10) Patent No.: US 6,176,886 B1
(45) Date of Patent: Jan. 23, 2001

(54) MIDDLE DISTILLATE FUELS WITH ENHANCED LUBRICITY COMPRISING THE REACTION PRODUCT OF A PHENOL FORMALDEHYDE RESIN, AN ALDEHYDE AND AN AMINO ALCOHOL

(75) Inventors: John T. Loper, Richmond, VA (US); Robert Quigley, Bracknell (GB); Timothy J. Henly, Maidens, VA (US)

(73) Assignee: Ethyl Corporation, Richmond, VA (US)

( * ) Notice: Under 35 U.S.C. 154(b), the term of this patent shall be extended for 0 days.

(21) Appl. No.: 09/386,707

(22) Filed: Aug. 31, 1999

(51) Int. Cl.[7] ..... C10L 1/22
(52) U.S. Cl. ..... 44/415; 44/424
(58) Field of Search ..... 44/415, 424

(56) References Cited

U.S. PATENT DOCUMENTS

| | | | | |
|---|---|---|---|---|
| 3,649,229 | | 3/1972 | Otto | 44/73 |
| 3,877,889 | | 4/1975 | Dix | 44/73 |
| 3,980,569 | * | 9/1976 | Pindar et al. . | |
| 4,054,554 | | 10/1977 | Buriks et al. | 260/59 |
| 4,071,327 | | 1/1978 | Dorer, Jr. | 44/66 |
| 4,166,726 | * | 9/1979 | Harle . | |
| 4,186,102 | | 1/1980 | Malec | 252/51.5 |
| 4,396,517 | * | 8/1983 | Gemmill, Jr. et al. . | |
| 4,673,412 | | 6/1987 | Stoldt et al. | 44/68 |
| 4,787,996 | | 11/1988 | Horodysky et al. | 252/51.5 |
| 5,876,468 | * | 2/1999 | Moreton . | |

FOREIGN PATENT DOCUMENTS

WO 98/16597 4/1998 (WO) .

* cited by examiner

*Primary Examiner*—Jerry D. Johnson
(74) *Attorney, Agent, or Firm*—Dennis H. Rainear; Thomas Hamilton; James T. Moore

(57) ABSTRACT

Mannich reaction products are disclosed as additives for hydrocarbon fuels. The Mannich reaction products are added to a low sulfur content, middle-distillate, compression ignition fuels in an amount effective to improve the lubricity of the fuel, typically within the range of from about 10 to about 1000 parts of additive per million parts fuel (ppm w/w), and thereby reduce the wear occasioned upon the fuel pump. Compositions comprising a hydrocarbon fuel and the reaction product are also disclosed.

11 Claims, No Drawings

MIDDLE DISTILLATE FUELS WITH ENHANCED LUBRICITY COMPRISING THE REACTION PRODUCT OF A PHENOL FORMALDEHYDE RESIN, AN ALDEHYDE AND AN AMINO ALCOHOL

TECHNICAL FIELD

The present invention relates to fuel compositions comprising additives for low sulfur, middle-distillate, compression ignition fuels, that increases the lubricity of the fuel without adding factors that would damage the fuel system of a vehicle using said fuel compositions or cause an increase in undesirable combustion by-products.

BACKGROUND OF THE INVENTION

Problems associated with fuel lubricity arose in the mid-1960's when a number of aviation fuel pump failures occurred. After considerable research, it was realized that advances in the refining of aviation turbine fuel had resulted in the almost complete removal of the naturally occurring lubricating components from the fuel. The removal of these natural lubricants resulted in the seizure of fuel pump parts. By the mid-1980's, it seemed likely that a similar problem was imminent in diesel fuel pumps. Fuel injection pump pressures had been steadily increasing while there was also a growing concern to reduce the sulfur content of the diesel fuel. The desire to reduce the sulfur content of the diesel fuel, in an effort to reduce pollution, required the use of more rigorous fuel refining processes. It was determined that as refining processes became more stringent, the naturally occurring oxygen containing compounds and polyaromatics which contribute to diesel fuel's inherent lubricity were eliminated.

Environmental concerns have led to a need for fuels with reduced sulfur content, especially diesel fuels. However, the refining processes that are used to produce fuels with low sulfur contents also result in a product of lower viscosity and a lower content of other components in the fuel that contribute to its lubricity, for example, polycyclic aromatics and polar compounds. Furthermore, sulfur containing compounds in general are regarded as providing anti-wear properties and a result of the reduction in their proportions, together with a reduction in proportions of other components providing lubricity, has been an increase in reported failures of fuel pumps in diesel engines using low sulfur fuels.

This problem may be expected to become worse in the future because in order to meet stricter requirements on exhaust emissions, high-pressure fuel pumps are being introduced and are expected to have more stringent lubricity requirements than present equipment.

In certain types of in-line diesel injection pumps, engine oil contacts diesel fuel. Engine oil may also come into contact with the diesel fuel through direct addition of used engine oil to the fuel. Certain types of lubricity additives used in low sulfur diesel fuel have been found to contribute to fuel filter blockage and to pump plunger sticking. Lubricity additives having poor compatibility with engine oil have been shown to cause these problems. Compatibility is defined as the tendency for the diesel fuel containing the lubricity additive not to form fuel insoluble deposits, gels or heavy sticky residues when in contact with engine oil. These deposits, gels or residues have been shown to cause fuel filter blockage and injection pump sticking. The additives of the present invention are compatible with engine oil.

Mannich reaction products have been taught for use as detergent/dispersants in fuels, primarily gasoline, for years.

The prior art Mannich reaction products typically contain high molecular weight alkyl groups on the hydroxyaromatic compounds. In contrast, the Mannich reaction products of the present invention are obtained from alkyl-substituted hydroxyaromatic compounds wherein the alkyl group contains from 9 to 30 carbon atoms.

U.S. Pat. No. 3,877,889 discloses Mannich bases useful as additives for liquid fuels to impart dispersancy, anti-icing and rust inhibiting properties. The reference fails to teach the use of said Mannich reaction products as lubricity additives in low sulfur compression ignition fuels.

U.S. Pat. No. 4,231,759 teaches reaction products obtained from the Mannich condensation of high molecular weight alkyl-substituted hydroxy aromatic compounds, amines and aldehydes for improving the detergency of liquid hydrocarbon fuels.

U.S. Pat. No. 5,853,436 discloses diesel fuel compositions containing a lubricity enhancing amount of a salt of an alkyl hydroxyaromatic compound and an aliphatic amine. These salts are different than the reaction products of the present invention.

While the prior art is replete with numerous treatments for fuels, it does not disclose the addition of the present additives to low sulfur compression ignition fuels or teach their use for providing enhanced lubricity to said fuels.

SUMMARY OF THE INVENTION

The present invention relates to the treatment of a low sulfur, middle-distillate, compression-ignition fuel to substantially reduce the wear occasioned upon fuel pumps used to pump said fuels. The present invention also relates to the discovery that the addition to a fuel of the reaction products of the present invention will significantly improve lubricity as compared to a similar fuel that has not been treated with said additive. Further, the present invention provides an additive that is economical, will not damage the fuel system, will not cause an increase in the level of undesirable combustion products and is lubricant compatible.

Thus, there is disclosed a fuel composition comprising a major amount of a low sulfur, compression ignition fuel and a minor amount of a Mannich additive. This Mannich additive unexpectedly decreases the fuel composition's ability to cause wear to fuel pump components that come into contact with said fuel composition. The Mannich additive is preferably present in the fuel in an amount within the range of from about 10 parts by weight of additive per million parts by weight fuel (ppm w/w) to about 1000 ppm w/w. More preferably, the Mannich additive is present in the fuel in an amount within the range from about 20 ppm w/w to about 500 ppm w/w, most preferably, from about 30 ppm w/w to about 300 ppm w/w.

There is also disclosed a method for reducing the wear of fuel pumps through which a fuel is pumped, comprising adding a fuel-soluble additive to said fuel wherein the fuelsoluble additive comprises a Mannich additive and wherein the Mannich additive is added to the fuel in an amount effective to improve the lubricity of the fuel, typically, the Mannich additive is present in the fuel composition in an amount of at least 10 ppm w/w, preferably from 20 to about 500 ppm w/w.

Also disclosed is a fuel composition comprising a low sulfur content, compression ignition fuel and a lubricity additive, said lubricity additive comprising a Mannich additive obtained by reacting a low molecular weight alkyl-substituted hydroxyaromatic compound, an aldehyde and an amino-alcohol under suitable Mannich condensation reaction conditions to obtain said Mannich additive.

In view of the problems discussed above, a general aspect of the present invention is to provide a fuel additive to protect the fuel pump from excessive wear and breakdown. A further aspect of the invention is to provide a fuel-soluble additive suitable for addition to a fuel that does not damage the fuel system and does not cause an increase in undesirable combustion products. Yet another aspect of the invention is to provide a fuel additive that works in conjunction with other additives such as detergents so that the life of the internal combustion engine, and especially the fuel pump, can be extended.

DETAILED DESCRIPTION OF THE INVENTION

The Mannich reaction products useful as lubricity additives in the fuel compositions of the present invention are fuel-soluble reaction products obtained by the reaction of a low molecular weight alkyl-substituted hydroxyaromatic compound, an aldehyde an amino-alcohol under suitable Mannich reaction conditions.

The low molecular weight alkyl-substituted hydroxyaromatic compounds and aldehydes used in the preparation of the Mannich reaction products of the present invention may be any such compounds known and applied in the art, in accordance with the foregoing limitations.

The alkyl-substituted hydroxyaromatic compounds that may be used in forming the present Mannich additives may be prepared by alkylating a hydroxyaromatic compound, such as phenol. The hydroxyaromatic compound may be mono-alkylated or di-alkylated. The alkylation of the hydroxyaromatic compound is typically performed in the presence of an alkylating catalyst at a temperature in the range of about 50 to about 200° C. Acidic catalysts are generally used to promote Friedel-Crafts alkylation. Typical catalysts used in commercial production include sulphuric acid, $BF_3$, aluminum phenoxide, methanesulphonic acid, cationic exchange resin, acidic clays and modified zeolites.

The low molecular weight alkyl-substituents on the hydroxyaromatic compound contain from 9 to 30 carbon atoms, preferably 12 to 18 carbon atoms. The low molecular weight alkyl substituents include alpha-olefins having single carbon number fraction between C9 and C30 or a mixture of carbon number fractions between C9 and C30. The alpha-olefins may be isomerized to produce an olefin containing an internal double bond, which may be used for alkylation of the hydroxyaromatic compound. Also useful as the low molecular weight alkyl substituent are oligomers of 1-olefins. Preferred olefin oligomers include propylene trimers (C9) and propylene tetramers (C12).

The low molecular weight Mannich additive may be, and preferably is, made from a low molecular weight alkyl-substituted phenol. However, other hydroxyaromatic compounds may be used including low molecular weight alkyl-substituted derivatives of resorcinol, hydroquinone, cresol, catechol, xylenol, hydroxydiphenyl, benzylphenol, phenethylphenol, naphthol, tolylnaphthol, among others.

The preferred configuration of the alkyl-substituted hydroxyaromatic compound is that of a para-substituted mono-alkylphenol. However, any alkylphenol readily reactive in the Mannich condensation reaction may be employed. Thus, low molecular weight Mannich additives made from alkylphenols having only one ring alkyl substituent, or two or more ring alkyl substituents are suitable for use in this invention.

Suitable amino-alcohols for use in the present invention include 2-arnino-1,3-propanediol, 3-amino-1,2-propanediol, ethanolamine and diethanolamine. The most preferred amino-alcohol used in forming the Mannich products of the present invention is diethanolamine. It has been discovered that the use of diethanol amine in forming the Mannich additives of the present invention yields additives which exhibit not only improved lubricity in a wide range of diesel fuels but also improved water separation, compared to Mannich reaction products prepared from different amines, as well as reaction products prepared from other hydroxy-substituted amines.

Representative aldehydes for use in the preparation of the low molecular weight Mannich additives include the aliphatic aldehydes such as formaldehyde, acetaldehyde, propionaldehyde, butyraldehyde, valeraldehyde, caproaldehyde, heptaldehyde, stearaldehyde. Aromatic aldehydes that may be used include benzaldehyde and salicylaldehyde. Illustrative heterocyclic aldehydes for use herein are furfural and thiophene aldehyde, etc. Also useful as aldehydes in the present invention are formaldehyde-producing reagents such as paraformaldehyde, or aqueous formaldehyde solutions such as formalin. Most preferred is formaldehyde or formalin.

The condensation reaction among the alkyl-substituted hydroxyaromatic compound, the amine and the aldehyde may be conducted at a temperature in the range of about 40° to about 200° C. The reaction can be conducted in bulk (no diluent or solvent) or in a solvent or diluent. Water is evolved and can be removed by azeotropic distillation during the course of the reaction. Typically, the Mannich additives are formed by reacting the alkyl-substituted hydroxyaromatic compound, amine and aldehyde in the molar ratio of 1.0:0.5–2.0:0.5–3.0, respectively.

In a preferred embodiment of the present invention, phenol formaldehyde resins are produced and a Mannich reaction is subsequently carried out on the resins. The resins may be produced by acidic, basic or neutral catalysis of the low molecular weight alkyl-substituted hydroxyaromatic compound and an aldehyde. The resins produced typically contain a distribution from monomeric hydroxyaromatic compounds up to eight ring polymers. The resin is further reacted with an aldehyde and at least one amine in a Mannich reaction to produce the final products.

When formulating the fuel compositions of this invention, the Mannich additive (with or without other additives) is employed in an amount effective to improve the lubricity of the fuel. Generally speaking the fuels of this invention will contain, on an active ingredient basis, an amount of low molecular weight Mannich additive in the range of about 10 to about 1000 parts by weight of additive per million parts by weight fuel.

An advantage of the present invention is that the additive reaction product does not adversely impact upon the activity of other fuel additives such as detergents. Further, the additives according to the invention do not detrimentally impact the combustion properties of the fuel nor do they contribute contaminating factors to the combustion gases. Further, the additives of the present invention are highly effective and thus, a low treat rate is possible to achieve a desired level of lubricity performance, thus providing an economic mechanism to extend the useful life of fuel pumps.

The fuel compositions of the present invention may contain supplemental additives in addition to the lubricity additive reaction products described above. Said supplemental additives include detergents, dispersants, cetane improvers, antioxidants, carrier fluids, metal deactivators, dyes, markers, corrosion inhibitors, biocides, antistatic additives, drag reducing agents, demulsifiers, dehazers, anti-icing additives, additional lubricity additives and combustion improvers. Preferred detergents/dispersants for use in the fuel compositions of the present invention include hydrocarbyl succinimides; Mannich condensation products comprising the reaction products of a high molecular weight alkyl-substituted hydroxyaromatic compound, an aldehyde and a polyamine; and hydrocarbyl amines.

The base fuels used in formulating the fuel compositions of the present invention include middle-distillate fuel, compression ignition fuels having a sulfur content of up to about 0.2% by weight, more preferably up to about 0.05% by weight, as determined by the test method specified in ASTM D 2622-98. The preferred fuels for use in the present invention are low sulfur content diesel fuels.

The additives used in formulating the preferred fuels of the present invention can be blended into the base fuel individually or in various sub-combinations. However, it is preferable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

The examples given below illustrate the novel fuel compositions of the present invention. Unless otherwise specified, all proportions are given by weight. The following examples are not intended or should not be construed as limitations of the invention as presently claimed.

EXAMPLES

In the following Examples, three different fuels, representative of various classes of diesel fuels, were used. Table 1 sets forth physical properties of the diesel test fuels used in the following Examples. Fuel A was a Far Eastern low sulfur diesel fuel, Fuel B was a CEC experimentation RF93-T-95 batch 2 fuel and Fuel C was a Scandinavian Class 1 diesel fuel.

| | Fuel A | Fuel B | Fuel C |
|---|---|---|---|
| | Distillation by IP 123 | | |
| IBP (° C.) | Insufficient sample | 179 | 192 |
| T50 (° C.) | " | 276 | 227 |
| T95 (° C.) | " | 344 | 274 |
| FBP (° C.) | " | 352 | 290 |
| Cloud Point (° C.) | " | −5 | −40 |
| % Sulfur | 0.0125 | 0.037 | <0.001 |
| Density at 15° C. (ASTM D4052) | 0.841 | 0.844 | 0.815 |
| | Hydrocarbon types by FIA (IP156) | | |
| % Aromatics | 27.9 | 27.2 | 3.5 |
| % Olefins | 1.5 | 1.1 | 1.1 |
| % Saturates | 70.6 | 71.6 | 95.5 |

The high frequency reciprocating rig (HFRR) was used to evaluate various Mannich reaction products and their effect on diesel fuel lubricity according to CEC F-06-A-96. The alkyl phenols and amines used are set forth in the following Tables. The HFRR apparatus and the procedure used are described as follows. A steel ball is attached to an oscillating arm assembly and is mated to a steel disk specimen in the HFRR sample cell. The sample cell contains 2 ml of the fuel being tested and the sample is maintained in a bath at a temperature of 60 ° C. A load of 500 grams is applied to the ball/disk interface by dead weights. The ball assembly is oscillated over a 1 mm path at a rate of 20 Hertz. These conditions ensure that a fluid film does not build up between the ball and disk. After a prescribed period of time, the steel ball assembly is removed. Wear, and hence the lubricity of the fuel, is assessed by measuring the mean wear scar diameter (MWSD) on the ball, resulting from oscillating contact with the disk. The smaller the wear scar obtained the greater the lubricity of the fuel.

The Mannich reaction products were obtained by reacting an alkyl phenol, an amine and formaldehyde in molar ratios of 1/1/1. The alkyl phenols used to prepare the Mannich reaction products set forth in the following Tables were propylene trimer alkylated phenol (C9), propylene tetramer alkylated phenol (C12), octadecyl phenol (C18) and a decene trimer alkylated phenol (C30). The amines used in the preparing the Mannich reaction products were ethylene diamine (EDA), diethylene triamine (DETA), monoethanol amine (MEA), and diethanol amine (DEA).

In Table 2, the Mannich samples were added to a Far Eastern low sulfur diesel fuel (Fuel A).

TABLE 2

HFRR results in Fuel A

| Sample | Mannich additive | ppm v/v | MWSD (μm) |
|---|---|---|---|
| 1* | Base fuel | — | |
| 2* | C12/EDA | 50 | 531[2] |
| 3* | C12/EDA | 100 | 480[2] |
| 4 | C12/DEA | 50 | 449.5[2] |
| 5 | C12/DEA | 100 | 340.5[2] |
| 6 | C12/MEA | 50 | 302[2] |
| 7 | C12/MEA | 100 | 389[2] |

*Comparative Example
[2]Average of two tests

In Table 3, the Mannich samples were added to a CEC RF93-T-95 batch 2 diesel fuel (Fuel B).

TABLE 3

HFRR results in Fuel B

| Sample | Mannich additive | ppm v/v | MWSD (μm) |
|---|---|---|---|
| 1* | Base fuel | — | 546[2] |
| 2* | C12/EDA | 50 | 373[2] |
| 3* | C12/EDA | 100 | 357[2] |
| 4 | C12/DEA | 50 | 314[2] |
| 5 | C12/DEA | 100 | 338[2] |
| 6 | C12/MEA | 50 | 289[2] |
| 7 | C12/MEA | 100 | 361.5[2] |

*Comparative Example
[2]Average of two tests

In Table 4, the Mannich samples were added to a Scandinavian Class 1 diesel fuel (Fuel C).

TABLE 4

HFRR results in Fuel C

| Sample | Mannich additive | ppm v/v | MWSD (μm) |
|---|---|---|---|
| 1* | Base fuel | — | 650 |
| 2* | C12/EDA | 150 | 525 |
| 3* | C12/EDA | 200 | 408.5[2] |
| 4 | C12/DEA | 150 | 400 |
| 5 | C12/DEA | 200 | 359[4] |

TABLE 4-continued

HFRR results in Fuel C

| Sample | Mannich additive | ppm v/v | MWSD (μm) |
|---|---|---|---|
| 6 | C12/MEA | 200 | 417[2] |
| 7* | C12/DETA | 200 | 476.5[2] |
| 8 | C12/2-amino-1,3-propanediol | 200 | 349[2] |
| 9 | C12/3-amino-1,2-propanediol | 200 | 338.5[2] |
| 10 | C18/MEA | 200 | 369[2] |
| 11 | C18/DEA | 200 | 345.5[2] |

*Comparative Example
[2]Average of two tests
[4]Average of four tests

It is clear, upon examination of the data in Tables 2–4, that the fuel compositions containing the additives of the present invention significantly reduce the wear scar on the ball and hence exhibit improved lubricity as compared to base fuel alone. Further, the additives of the present invention provide improved lubricity in a broad range of diesel fuels.

The efficacy of the lubricity additives of the present invention was assessed using the Scuffing Load BOCLE (ball-on-cylinder lubricity evaluator) test (ASTM D 6078-97).

The Scuffing Load BOCLE test allows discrimination and ranking of fuels of differing lubricity. The Scuffing test simulates the severe modes of wear failure encountered in fuel pumps and therefore provides results which are representative of how the fuel would behave in service. The load at which wear failure occurs is referred to as the scuffing load and is a measure of the inherent lubricity of the fuel. The scuffing load is primarily identified by the size and appearance of the wear scar on the ball, which is considerably different in appearance to that found under milder non-scuffing conditions. Fuels giving a high scuffing load on failure have better lubricating properties than fuels giving a low scuffing load on failure. All tests were conducted in a Jet A fuel containing 100 ppm w/w of the Mannich reaction product.

Table 5 demonstrates the effectiveness of the additives of the present invention. Higher Scuffing Load BOCLE values are indicative of improved lubricity.

TABLE 5

Scuffing Load BOCLE

| Sample | Additive | Load (g) |
|---|---|---|
| 1* | Base fuel | 1200 |
| 2 | C9/MEA | 1600 |
| 3 | C9/DEA | 2200 |
| 4 | C12/2-amino-1,3-propanediol | 2200 |
| 5 | C12/3-amino-1,2-propanediol | 2000 |
| 6 | C18/MEA | 1400 |
| 7 | C18/DEA | 2000 |
| 8* | Base fuel | 1600 |
| 9 | C12/DEA | 3200 |

It is clear, upon examination of the data in Table 5, that the fuel compositions containing the additives of the present invention exhibit improved lubricity as compared to base fuel alone.

The following Table 6 shows the improved water separation ability of diethanol amine Mannich derivatives of the present invention compared to other diethanol amine derivatives. Water separation was determined according to ASTM D1094 using either Fuel B or Fuel C, when indicated, as the base fuel. In this test, a sample of the fuel is shaken, using a standardized technique, at room temperature with a phosphate buffer solution in a scrupulously cleaned glassware. The cleanliness of the glass cylinder is tested. The change in volume of the aqueous layer and the appearance of the interface are taken as the water reaction of the fuel. An Interface Rating of 1b represents the appearance of clear bubbles covering not more than an estimated 50% of the interface and no shreds, lace, or film at the interface; an Interface Rating of 2 represents the appearance of shred, lace, or film, or scum at the interface; and an Interface Rating of 4 represents the appearance of tight lace or heavy scum at the fuel/water interface.

TABLE 6

| Additive | Treat Rate ppm v/v | Interface Rating | Fuel/Water Separation Rating | Volume Aqueous | Volume Emulsion | Appearance Aqueous |
|---|---|---|---|---|---|---|
| DEA/acid[1]* | 50 | 4 | 3 | 15 | 5 | Slight |
| C12 DEA | 100 | 1b | 3 | 20 | 0 | Good |
| C12 DEA | 200 | 1b | 3 | 20 | 0 | Good |
| C18 DEA | 100 | 4 | 3 | 20 | 0 | Slight |
| C12 DEA[C] | 200 | 1b | 3 | 20 | 0 | |
| C12 DEA[C] | 300 | 1b | 3 | 20 | 0 | |
| C12 EDA* | 50 | 4 | 3 | 5 | 15 | Slight |
| C12 EDA* | 200 | 4 | 3 | 5 | 15 | Slight |
| C12 EDA*[C] | 300 | 4 | 3 | 15 | 5 | |
| C12 MEA | 50 | 4 | 3 | 10 | 10 | Slight |
| C12 MEA | 200 | 4 | 3 | 5 | 15 | Slight |
| C18 MEA | 100 | 4 | 3 | 14 | 6 | Slight |
| C12 MEA[C] | 300 | 4 | 3 | 19 | 1 | |
| C12 2-amino-1,3-propanediol | 100 | 4 | 3 | 12 | 8 | Slight |
| C12 3-amino-1,2-propanediol | 100 | 4 | 3 | 5 | 15 | Slight |
| Base Fuel B* | 0 | 2 | 3 | 20 | 0 | Slight |

[1]Diethanolamide of a fatty acid. Not within the scope of the present invention.

TABLE 6-continued

| Additive | Treat Rate ppm v/v | Interface Rating | Fuel/Water Separation Rating | Volume Aqueous | Volume Emulsion | Appearance Aqueous |
|---|---|---|---|---|---|---|

*Comparative Example
[C]Fuel C was used in these Examples

It is clear, upon examination of the above Table, that the DEA derivatives have excellent water separation properties as fuels containing these derivatives were the only ones that shed the full 20 ml of water within the required five minute period after completing shaking. This excellent water separation ability allows for formulation of fuel compositions without the need for a demulsifier.

In the following Examples, a low molecular weight resole was formed by the reaction of C12 alkyl (propylene tetramer) phenol and formaldehyde under base catalysis to form a resin predominantly comprising monomeric, dimeric, trimeric and tetrameric resole structures. The resole was then reacted with formaldehyde and diethanol amine to form the Mannich derivative. Table 7 demonstrates the lubricity properties of these Mannich resins as shown by the HFRR results.

TABLE 7

| Additive | Treat Rate | MWSD |
|---|---|---|
| Base Fuel C | 0 | 650 |
| Resole C12 DEA | 150 | 423[2] |
| Resole C12 DEA | 200 | 356[2] |

[2]Average of two tests

It is clear from the decreasing MWSD in Table 7 that the Mannich resins are effective lubricity additives.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as formation of the lubricity additive reaction products) or in forming a desired composition (such as an additive concentrate or additized fuel blend). It will also be recognized that the additive components can be added or blended into or with the base fuels individually per se and/or as components used in forming preformed additive combinations and/or subcombinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations is thus wholly immaterial for an accurate understanding and appreciation of this disclosure and the claims thereof.

As used herein the term "fuel-soluble" means that the substance under discussion should be sufficiently soluble at 20° C. in the base fuel selected for use to reach at least the minimum concentration required to enable the substance to serve its intended function. Preferably, the substance will have a substantially greater solubility in the base fuel than this. However, the substance need not dissolve in the base fuel in all proportions.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A fuel composition comprising a major proportion of a middle-distillate, compression ignition fuel having a sulfur content of less that 0.2% by weight and a minor proportion of the reaction product of a phenol formaldehyde resin, an aldehyde and an amino-alcohol.

2. The fuel composition of claim 1 wherein the phenol formaldehyde resin is obtained by reacting a low molecular weight alkyl-substituted hydroxyaromatic compound and an aldehyde under acidic, basic or neutral catalysis, wherein the low molecular weight alkyl-substituent on said hydroxyaromatic compound comprises from 9 to 30 carbon atoms.

3. The fuel composition of claim 2 wherein the phenol formaldehyde resin is obtained by reacting a low molecular weight alkyl-substituted hydroxyaromatic compound and an aldehyde under acidic catalysis.

4. The fuel composition of claim 2 wherein the phenol formaldehyde resin is obtained by reacting a low molecular weight alkyl-substituted hydroxyaromatic compound and an aldehyde under basic catalysis.

5. The fuel composition of claim 2 wherein the low molecular weight alkyl-substituent on said hydroxyaromatic compound comprises from 12 to 18 carbon atoms.

6. The fuel composition of claim 1 wherein the amino-alcohol is selected from the group consisting of 2-amino-1,3-propanediol, 3-amino-1,2-propanediol, monoethanol amine, diethanol amine and mixtures thereof.

7. The fuel composition of claim 1 wherein said reaction product is present in the fuel in an amount within the range from about 10 to about 1000 parts by weight of additive per million parts by weight of fuel.

8. The fuel composition of claim 7 wherein said reaction product is present in the fuel in an amount within the range from about 20 to about 500 parts by weight of additive per million parts by weight of fuel.

9. The fuel composition of claim 1 wherein said amino-alcohol is diethanol amine.

10. The fuel composition of claim 1 further comprising at least one additive selected from the group consisting of detergents, dispersants, cetane improvers, antioxidants, carrier fluids, metal deactivators, dyes, markers, corrosion inhibitors, biocides, antistatic additives, drag reducing agents, demulsifiers, dehazers, anti-icing additives, additional lubricity additives and combustion improvers.

11. A method for reducing the wear of fuel pumps through which a low sulfur content, middle-distillate, compression ignition fuel is pumped, comprising using as the fuel to be pumped through the fuel pump the fuel composition of claim 1.

* * * * *